US008046852B1

(12) United States Patent
Hoo

(10) Patent No.: US 8,046,852 B1
(45) Date of Patent: Nov. 1, 2011

(54) BED SHEET WITH POCKETS

(75) Inventor: Fan Shi Hoo, Kwun Tong (HK)

(73) Assignee: Pac-Fung Feather Co., Ltd., Kowloon (HK)

( * ) Notice: Subject to any disclaimer, the term of this patent is extended or adjusted under 35 U.S.C. 154(b) by 0 days.

(21) Appl. No.: 12/825,130

(22) Filed: Jun. 28, 2010

(51) Int. Cl.
*A47G 9/02* (2006.01)

(52) U.S. Cl. ..... 5/485; 5/694

(58) Field of Classification Search ..... 5/485, 482, 5/497–499, 694
See application file for complete search history.

(56) References Cited

U.S. PATENT DOCUMENTS

| | | | | |
|---|---|---|---|---|
| 4,422,195 | A * | 12/1983 | Russo et al. | 5/497 |
| 5,517,696 | A * | 5/1996 | Krugler | 2/250 |
| 6,594,836 | B1 * | 7/2003 | Everson et al. | 5/485 |
| 7,131,152 | B2 * | 11/2006 | Wootten et al. | 5/485 |
| 7,526,822 | B2 * | 5/2009 | Joyce | 5/485 |

* cited by examiner

*Primary Examiner* — Fredrick Conley
(74) *Attorney, Agent, or Firm* — Leason Ellis LLP.

(57) ABSTRACT

A bed sheet is made of: a material body with inner and outer surfaces configured to substantially cover a mattress. The sheet is provided with at least one pair of co-located pockets provided on the material body. The pockets are substantially rectangular and are placed one on top of the other. The outermost pocket has a height less than that of the inner pockets. The top edges of each pocket are open and slope in opposite direction to facilitate selective placement of objects in one pocket or the other.

5 Claims, 4 Drawing Sheets

BED SHEET WITH POCKETS

BACKGROUND OF THE INVENTION a. Field of the Invention

The invention relates generally to a bed sheet with easily accessible side pockets. The bed sheet itself is a conventional fitted sheet having an elastic band circumferentially located on an outer perimeter of the bed sheet, and seams at the corners which form side panels. The pocket(s) are located on one or more side panels of the fitted sheet and designed for quick ingress and egress of objects from multiple closely located or co-located pockets.

b. Description of the Related Art

In the art there exists a variety of known bed sheets for mattresses. A sub-portion of these prior art bed sheets posses pockets and other similar mechanisms for the retention of objects. Prior art bed sheets with pockets use a variety of materials and means for securing the objects within the pocketed space.

Known prior art bed sheets are disclosed for example in U.S. Pat. No. 7,131,152 to Wootten et al., U.S. Pat. No. 6,684,422 to LeFevere et al., U.S. Design Pat. No. 471,049, U.S. Design Pat. No. 587,055, U.S. Design Pat. No. 537,286 and U.S. Design Pat. No. 481,899.

U.S. Pat. No. 7,131,152 to Wootten ("Wootten") is directed to a bed sheet with a side pocket. The pocketed bed sheet includes a fabric body to substantially cover a mattress and a pocket provided on the fabric body. The pocket includes a wall to hold objects in the pocket and a diagonal fabric edge that defines a diagonal opening at an angle relative to an edge of the fabric body. FIG. 3 of Wootten shows a typical fitted sheet with material sewn on the outer surface of the bed sheet (i.e., a patch pocket). The opening of the patch pocket is a diagonal fabric opening at an angle relative to an edge of the fabric body. The pocket described is roughly rectangular in shape. The Wootten patent explains that side edge 34 may extend approximately one-half the length of the entire height of pocket 12 as defined by side edge 36. The top edge 38 may extend approximately one-half the length of the entire width of pocket 12 as defined by bottom 40. Corners 42, 44 of edges 34, 38, respectively, form a diagonal opening 46 defined by edge 48. Alternatively, FIG. 4 depicts an embodiment of the pocket with an approximately semi-circle to form a partially enclosed compartment. The edge 52 "form[s] ends for diagonal opening 46." The Wootten patent, column 5, lines 3-8. As depicted in FIG. 4, the edge 52 begins along the top of the pocket at a point opposite a location about a third of the distance from a left bottom curve of the pocket. The edge 52 extends rightward from that point to then curve downward at a point about even with the right bottom corner of the pocket. The edge 52 continues downward and curves leftward to form a bottom of the pocket and returns upward to form the left end of the pocket. The Wootton patent describes that edge 48 of pockets 12, 12' may include an elastic lining.

An obvious draw back of the pouches described by Wootton is that objects must be angled into a position matching the diagonal opening of the pocket. As such, ease of egress and ingress of objects is hampered by not only the pocket opening position, but placement of the pocket in general. More importantly, the designs of the pockets in Wootton prevent the use of multiple pockets that are co-located or serially located next to one another. It also makes it difficult to access the pockets if one is in a prone position on the bed.

Additionally, there is a need for others to access the pockets while not using it (i.e. while not in the prone position) on the bed. It is also necessary to have full access to the pocket interior for sanitary and observation reasons. The pockets as described in Wootton, fail to give total access to the interior of the pocket, The angled opening obscures the space directly adjacent to the opening. As such objects can not be located there if their dimensions exceed the pocket dimensions. Alternatively, if the objects are of small dimensions, a user may not be able to locate an object that has migrated to this space. Wootten thereby eliminates some of the usable pocket volume that it describes.

Another type of pocketed sheet is disclosed by U.S. Pat. No. 6,684,422 to LeFevere et al. ("LeFevere"). LeFevere is directed to an infant blanket that has mechanisms for attaching items to the blanket (e.g., small toys such as pacifiers, teethers, rattles) and describes two pockets 822, 823 sewn to the blanket for containing such items. LeFevere, column 6, lines 27-31; and FIG. 8. LeFevere, in FIG. 8 depicts each pocket being formed from an arcuate piece of material, where each pocket has one short side edge and an opposing, longer side edge. Each of the pockets 822, 823 is formed with an opening that extends at an angle from the upper end of the short side edge across the top of the pocket to the upper end of the opposing, longer side edge. Items can be placed into pockets 822, 823 at any angle from vertical to horizontal relative to the orientation of the pocket.

While the pocket sheet in LeFevere overcomes some of the drawbacks of the pouches disclosed by Wootton, the pockets of LeFevere still fail to point out multiple co-located pockets whose openings are angled so as to allow ease of ingress and egress as well as ease of locating specific pockets.

It would therefore be a benefit to provide a bed sheet having side pockets designed with substantially angled openings that are co-located with another opposite angled pocket opening, or parallel located next to one another. It would also be of benefit to provide these pockets on the side panels of a fitted bed sheet. It would further be of benefit to provide a wide variety of pocket types for various articles. It would additionally be of benefit to incorporate pocket types using gusseted sides and elastic rims so as to secure objects located within, all the while allowing the bed sheet profile to maintain as little external bulging as possible. It would also be of benefit to proved pockets where in the maximum usable space is available for item storage. Additionally, it would be of benefit to provide pockets designed so as to allow a user to access a specific pocket in a grouping of pockets from both a vertical or prone position.

SUMMARY OF THE INVENTION

The present invention is a bed sheet including a material body sheet configured to substantially cover a mattress or other bedding device and a pocket(s) provided on the material body. The bed sheet itself is a conventional fitted sheet having an elastic band circumferentially located on an outer perimeter of the bed sheet, and seams at the corners which form side panels.

The material body of the bed sheet may comprise a top portion, side portions, and end portions. Adjacent side and end portions may be joined together or otherwise formed with the top portion to constitute vertical corners. The side and end portions may be made of the same material or different material than the top portion. The side and end portions may have upper and lower portions. Said lower portions may terminate at a position that extends beyond the corresponding length of the bedding device so as to allow envelopment on the reverse side of the bedding device. Elastic banding may extend along the entire length of the lower edge. The material body sheet may be fitted to conform to particular customary mattress or bedding device specifications.

The pocket(s) of the present invention are located on one or more side panels or end panels of the fitted sheet. The pockets are provided on, in or transverse to, the sheet material. The present invention sheet with pocket may include one side edge connected to another side edge by means of a material back or outer wall, and optionally an inner or front wall. The present invention pocket has a pocket opening that extends from one side edge across to another side edge The present invention may have an angled opening between the one side edge and another side edge.

The pocket according to the present invention may be formed from material sewn on to the outer surface of the bed sheet (i.e., a patch pocket), such that the pocket would have a side edge connected to another side edge by means of a back wall. The pocket itself may have two co-located rectangular pouches, with one pouch over the other pouch. The inner pouch may have a longer side edge than the outer pouch. The pouches are open at their top. The respective openings are angled in complimentary directions, i.e., the top edge of the inner pouch may slope downward from one side and the top edge of the outer pouch may slope downward from an opposite side than the inner pouch's top edge. Each pouch may have a gusset material along its vertical left and right sides (side edges) so as to allow the pocket to expand. A single line of vertical stitching, other materials adhesive, along a centerline of the pocket divides each pocket into two pouches. With co-located pockets, this creates four distinct pouches. The width of the pocket may be, for example, about 6¾ inches.

The pocket may comprise a patch pocket having gusseted material along its vertical left and right sides with the addition of fabric wrapped elastic bands along the angled openings of the four pockets formed from the inner and outer pouches.

The present invention pocket may be formed as a single-pouch patch pocket, wherein the pocket does not have any gusseting. The opening is angled, and has a fabric wrapped elastic band. A single line of vertical stitching divides the pouch into two sections. The width of the pocket may be about 6¾ inches, as an example. The pouch pocket may also, in the alternative, lack the fabric wrapped elastic band along the angled opening.

The pocket may be formed as a hidden pocket cavity. The cavity itself is formed by sewing a single piece of material to an inner surface of the bed sheet. The cavity is accessible through a finished slit in the bed sheet. The finished slit is formed by slicing the side surface of the bed sheet. The material at the bottom edge of the slice is folded downward inside the slice, and a panel of material is sewn on an inner side of the folded bottom portion to finish the front of the slit. The material at the top edge of the slice is folded upward inside the slice. The single piece of material is sewn along all its sides to the inner surface of the bed sheet side portion about the slice to form the cavity. This embodiment does not have any gusseting, or elastic banding. The width of such a pocket may be about 3½ inches. The top edge can be horizontal.

The present invention solves the problems and overcomes the drawbacks and deficiencies of prior art pocket sheets by providing a pocketed sheet that employs the use of co-located pockets that allow for a greater number of pockets to be placed in a given area. Additionally, the co-located pockets are counter angled from one layer to the next so as to insure proper object placement in a particular pocket. Also the pockets may be gusseted so as to allow a greater range of object dimensions, without putting undue stress of the side edges of the pocket. Even when the pockets are not co-located, the angled vertical opening and gusset material make for a marked improvement over the prior art.

Another object of an exemplary embodiment of the invention is to provide a sheet with side pockets wherein the opening to the side pocket is lined with elastic material so as to allow the object to be secured within the pocket without the use of fasteners of other securing devices.

Additional features, advantages, and embodiments of the invention may be set forth or apparent from consideration of the following detailed description, drawings, and claims. It is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENT

Figure 1:
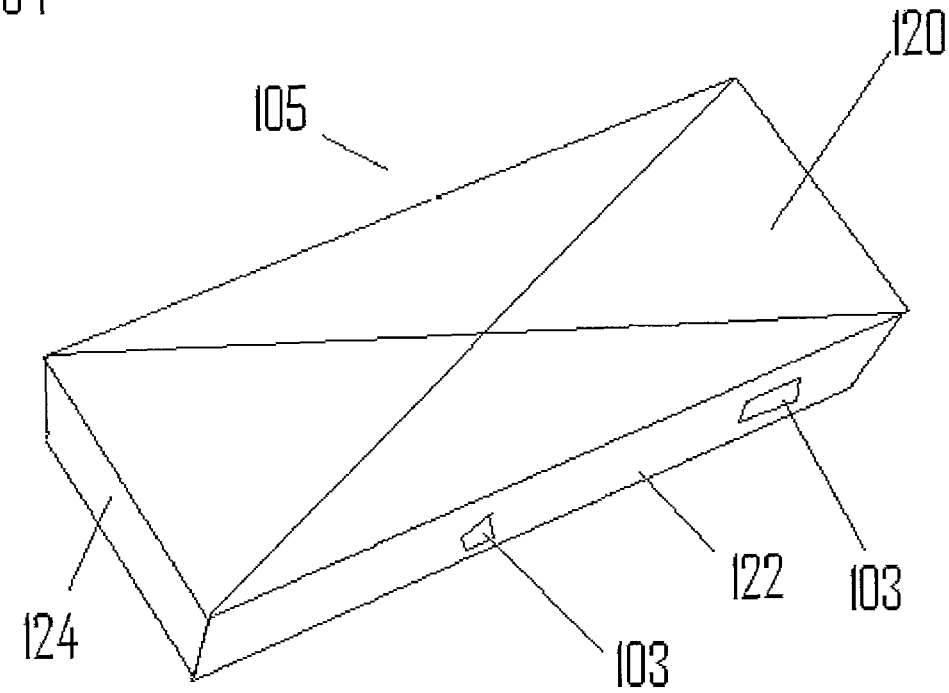
FIG. 1 is a perspective view of the pocketed bed sheet secured to a mattress or other bedding device.

Referring now to the drawings wherein like references numerals designate corresponding parts throughout several views, FIGS. 1-5 illustrate a bed sheet having pockets according to the present invention.

Specifically shown in FIG. 1 is a bed sheet 105 including a plurality of side pockets 103. The bed sheet is shown fitted to a convention mattress (mattress not shown). The mattress may be any mattress size or configuration. Additionally the mattress may encompasses not only standard spring and box mattress types, but any mattress-like device, including, but not limited to water-bed bladders, air mattresses, foam or gel mattresses and other bedding devices. The bedding may be fitted to the dimensions of the mattress via elastic edges, snaps, clasps or other devices allowing for the bed sheet to be located on the mattress.

The bed sheet material has a roughly rectangular shape with a top portion 120 and a bottom portion (not shown) corresponding to any material overlap, secured underneath the mattress. The material sheet has side panels 122 with an exterior surface and an interior surface. The side panel length is the length of the mattress and the width is the height of the mattress. The mattress sheet also has a top panel (not shown) and an end panel 124 both having an exterior surface and an interior surface. The top panel and end panel are joined to the side panels and the end panels to form corners adapted to fit over the mattress.

The bed sheet material can be made out of any material with suitable characteristics to be formed into a sheet with a top portion, a top end, joined side panels and a bottom end. Typical materials include, but are not limited, to cotton, linen, synthetic fibers and/or natural fiber combinations and synthetic or natural sheeting material or any combination thereof. One skilled in the art would recognize the types of materials capable of being used in the material sheet.

As shown in FIG. 1 the bed sheet has at least one pocket 103 that is located on a side panel of the material sheet and orientated so that the open end of the pocket is perpendicular to the length of the side panel The pocketed bed sheet as shown in FIG. 1 only depicts pockets on one side of the material sheet, but it would be known to those skilled in the art that a plurality of pockets may be placed on any side panel of the bed sheet in any configuration. Further, the pockets may be located on the top end and bottom end panels as desired.

Figure 2:
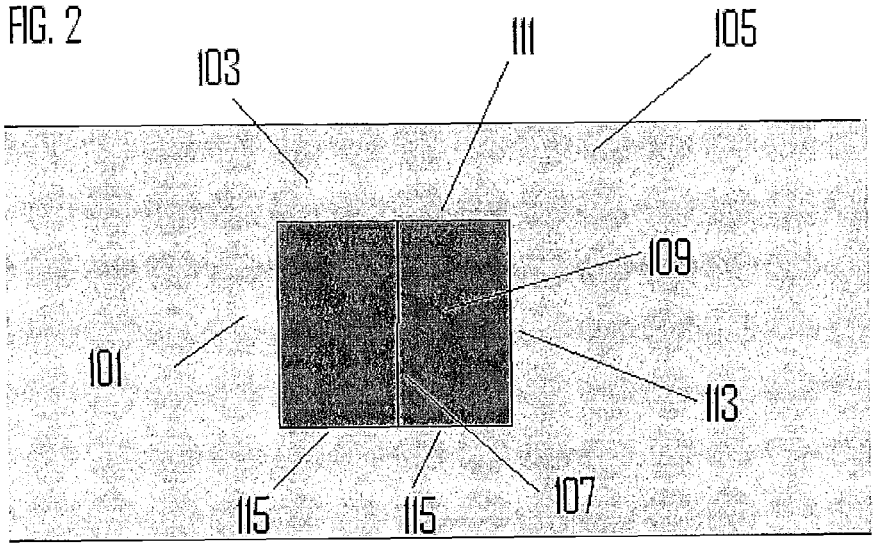
FIG. 2 an enlarged elevated view of the pocketed bed sheet of FIG. 1, illustrating a pocket.

As shown in FIG. 2, a pocketed bed sheet 105 of FIG. 1, includes at least one pocket 103. The pocket is provided on the bed sheet 105 and has a substantially rectangular shape. The pocket 103 is disposed on the bed sheet 105 by a side edge 101 connected to another side edge 113 by an outer or back wall 109, which is configured to contain an object. A bisecting line 107 joins the back wall 109 to the bed sheet and forms two distinct pouches 115. The top end 111 is open and allows for the egress and ingress of objects into the pouches.

Figure 3:
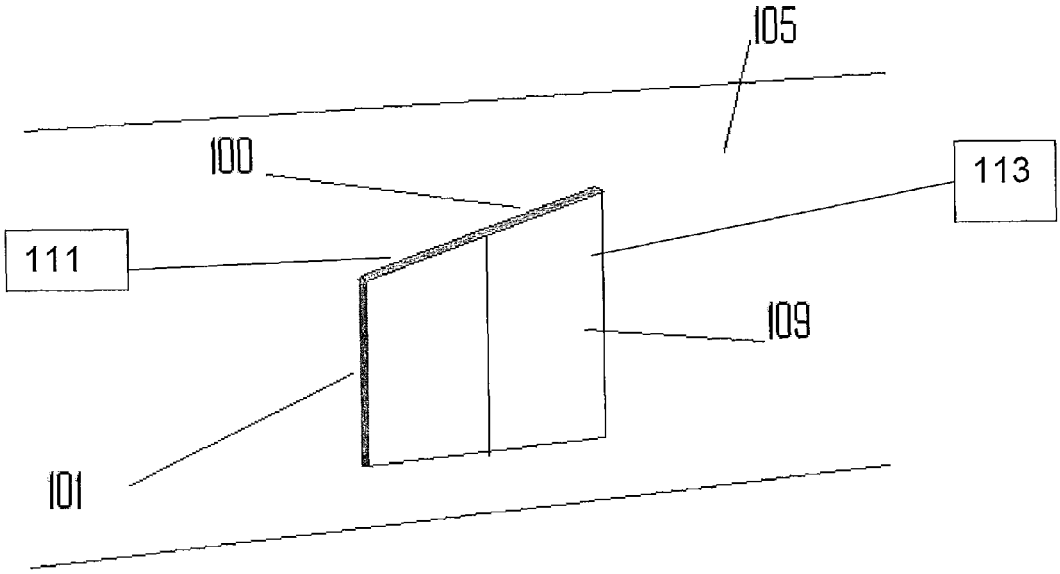
FIG. 3 an enlarged illustrated perspective view of the pocketed bed sheet of FIG. 1, illustrating a pocket having a top end angled downward from one side edge to another.

FIG. 3 shows a first embodiment where the top end 111 is angled from one side edge 101 to another side edge 113 and whose side edges 101, 113 are gusseted. FIG. 3 depicts a pocket that contains no object so that the gusseted side edges are not engaged and the entire pocket has a minimal profile In addition to gusseted side edges, it is possible to construct the top end 111 out of an elastic material (not shown). The combination of elastic material and the gusseted side edges allow expansion of the volume of each individual pocket on an as-needed basis. When not filled with an object, the gusseted side edges will lay flat, decreasing the side profile of the pocket. Conversely, when filled with an object, the gusseted sides allow the pocket to conform to the objects, whose dimensions may not be uniform, without putting undue stress on the side edges and the material body. In this same way, the elastic top end 111 will allow the pocket to secure objects within the pocket without the use of fastening devices. Additionally, the elastic top end 111 will allow objects whose dimensions exceed that of the pocket to still be securely retained by the pocket.

Figure 4:
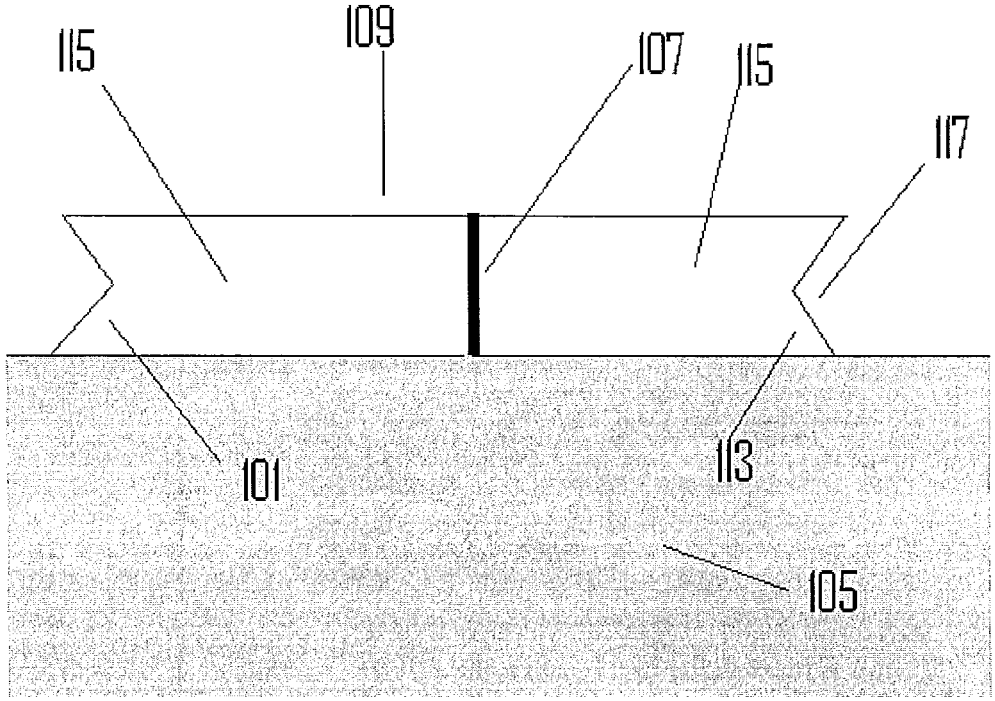
FIG. 4 an enlarged top-down illustrated view of the pocketed bed sheet of FIG. 1, illustrating a pocket with gusseted sides.

Specifically, as shown in the top view of FIG. 4, a pocketed bed sheet 105 as depicted in FIGS. 1-3, includes at least one pocket, wherein the side edges 101, 113 have gussets 117, and the gusseting is partially engaged. The pocket with the gusseted sides partially engaged increases the interior volume of the pouch depending on the dimensions of the object to be inserted. The bisecting line 107 that joins the back wall (outer) 109 to the sheet material 105 forming two distinct pouches 115, may be elastic.

Figure 5:
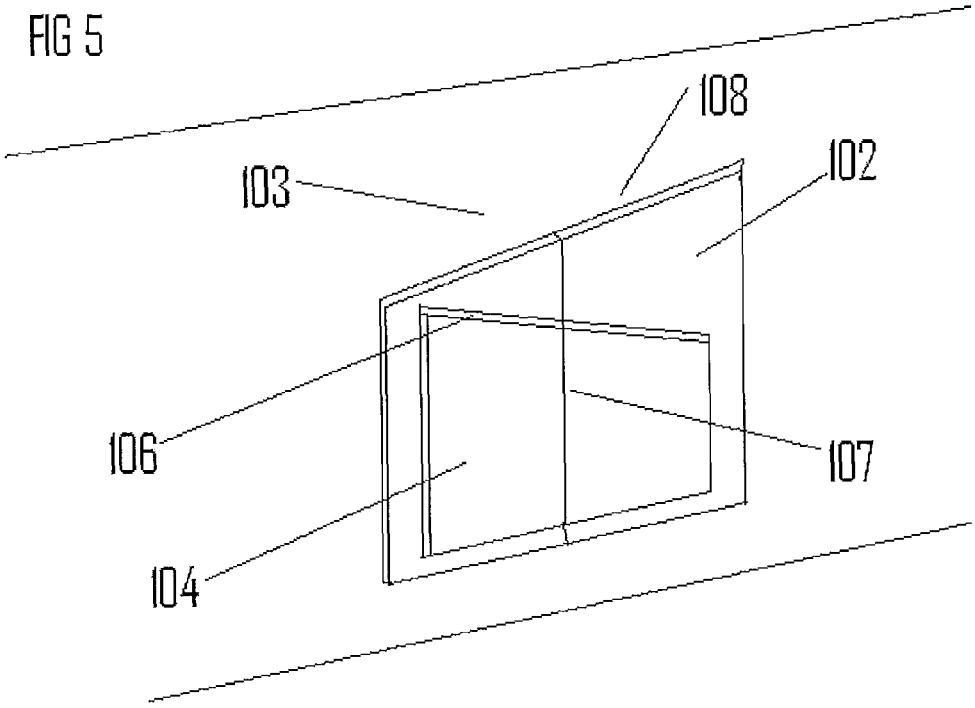
FIG. 5 an enlarged illustrated perspective view of the pocketed bed sheet of FIG. 1, illustrating a co-located pocket having an inner pocket and an outer pocket.

Referring to FIG. 5, there is shown a second embodiment of a pocketed bed sheet 105, wherein there are two pockets co-located with one another, thereby forming an inner pocket 102 and an outer pocket 104. The inner pocket 102 has a length of a side edge that is longer than the equivalent co-located side edge of the outer pocket. As shown in FIG. 5, the top end 108 of the inner pocket 102 is angled downward from one side edge to another. The outer pocket top end 106 of the outer pocket 104 is angled in the opposite direction to that of the inner pocket top end 108. In this embodiment, bisecting line 107 separates the co-located pockets 103 into 4 distinct pouches. This allows for ease of egress and ingress from a co-located pocket. Additionally, this configuration of openings allows for ease of locating a particular pouch.

If a user wants to place an object in the inner pocket 102, he would slide it toward the two co-located pockets at an angle perpendicular to the sloped edge 108. This would make it easy to enter the inner pocket and difficult to enter the outer pocket 104. Similarly, if the user wants to place an object in the outer pocket, he would slide it toward the two co-located pockets at an angle perpendicular to the sloped edge 106 of the outer pocket.

A third embodiment of a pocketed bed sheet would refer to FIG. 5, where the side edges of both the interior and exterior pockets are gusseted and/or the top ends of each individual pouch are made of elastic material. Also it should be understood that the two co-located pockets of FIG. 5 may have the same width. They may also have the same height, but that would make it more difficult to selectively place an object in one of the pockets.

Additional embodiments (not shown) are envisioned wherein the pocket 103 is located on the interior surface of a side or end panel and the top end of the pocket is accessed by an opening in the material sheet corresponding to the top end of the pocket.

Further, embodiments are envisioned wherein the pockets of FIG. 5 contain some elements of the embodiments. discussed above. One skilled in the art would appreciate that the features disclosed in the above embodiments may be combined or subtracted from a final product to fit particular design goals or material limitations.

For the pockets depicted in FIGS. 2-5, only one pocket is depicted. Those skilled in the art would appreciate that pockets of the variety disclosed in the above embodiments may be placed in any configuration upon the side panels, top panel and bottom panel, including on the side of the bed sheet not depicted in FIG. 1.

Based upon the discussion above, the pocketed bed sheet of the present invention solves the problems and drawbacks highlighted and found throughout the prior art. The pocketed bed sheet uses substantially vertical openings to allow for the maximum amount of interior volume. Additionally, the angled pockets on the bed sheet allow for items to be easily placed within the pockets. When pockets are co-located, the angled top ends allow for a user to easily identify the particular pocket they wish to access. The gusseted sides allow the pockets to maintain a minimal profile when not in use, but expand the volume of the pocket so as to accept large or irregular objects. The elastic bands also allow for the securing of irregular objects without the need of fasteners or other securing aids. This is readily apparent when an object, whose vertical dimensions extend beyond the opening of the pocket, is retained securely by the elastic action of the elastic top end.

Lastly, a hidden pocket allows for a more aesthetically pleasing external appearance to the bed sheet with pockets while still maintaining the functionality of side pockets. As shown in FIG. 3, a hidden pocket would be represented with side edges 101 and 113 being in dotted line to indicate that they are on the interior of the sheet. Top edge 111 would be a slit leading from the exterior of the sheet to the hidden pocket. The cavity itself is formed by sewing a single piece of material to an inner surface of the bed sheet. The cavity is accessible through a finished slit 111' in the bed sheet. The finished slit is formed by slicing the side surface of the bed sheet 105. The material at the bottom edge of the slit is folded downward inside the slice, and a panel of material is sewn on an inner side of the folded bottom portion to finish the front of the slit. The material at the top edge of the slit is folded upward inside the slice. The single piece of material is sewn along all its sides to the inner surface of the bed sheet side portion about the slit to form the cavity. This embodiment may also include gusseting, or elastic banding.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A pocketed bed sheet comprising:

a material body having inner and outer surfaces, configured to substantially cover a mattress; and a pair of co-located pockets provided on the material body, so as to produce an inner and an outer pocket in a given space, each of the pockets being substantially rectangular in shape and having: a side edge connected to another side edge by an outer wall, each pocket being open at a top end and the outer walls being attached to the material body at a bottom edge, the pockets being configured to contain one or more objects, and wherein the inner pocket has one side edge of longer length than its other side edge so that the top end of the inner pocket is angled in one direction so that the top end of the inner pocket slopes downward from one side edge to another, and the outer pocket has one side edge of longer length than its other side edge so that the top end of the inner pocket is angled in an opposite direction from the top end of the outer pocket to allow for selective placement of objects in the pockets.

2. A bed sheet as in claim 1 where at least one pocket is provided on the inside surface of the of the material body and is formed of a single piece of material;

wherein the open top end is accessed through a lateral opening in the material body and the single piece of material is joined to the inside surface and configured to contain one or more objects.

3. A bed sheet according to claim 1 wherein the pocket is hidden by having the outer wall on the inner surface of the material body, the top of the pocket being accessible via a slit in the material body.

4. A bed sheet as in any one of claims 1 and 3 wherein the top end of the outer wall is comprised of elastic material.

5. A bed sheet as in any one of claims 1 and 3, wherein the side edges are gusseted.

* * * * *